US009259052B2

(12) United States Patent
Lee

(10) Patent No.: US 9,259,052 B2
(45) Date of Patent: Feb. 16, 2016

(54) STRUCTURE OF HIGH-HEELED SHOE

(71) Applicant: Po-Yao Lee, Taichung (TW)

(72) Inventor: Po-Yao Lee, Taichung (TW)

( * ) Notice: Subject to any disclaimer, the term of this patent is extended or adjusted under 35 U.S.C. 154(b) by 290 days.

(21) Appl. No.: 14/106,859

(22) Filed: Dec. 16, 2013

(65) Prior Publication Data

US 2015/0164180 A1 Jun. 18, 2015

(51) Int. Cl.

| | |
|---|---|
| ***A43B 13/37*** | (2006.01) |
| ***A43B 21/24*** | (2006.01) |
| ***A43B 13/28*** | (2006.01) |
| ***A43B 7/14*** | (2006.01) |
| ***A43B 13/12*** | (2006.01) |
| ***A43B 13/14*** | (2006.01) |
| ***A43B 13/16*** | (2006.01) |
| ***A43B 21/51*** | (2006.01) |

(52) U.S. Cl.

CPC ..... *A43B 21/24* (2013.01); *A43B 7/142* (2013.01); *A43B 7/144* (2013.01); *A43B 7/145* (2013.01); *A43B 7/148* (2013.01); *A43B 7/1425* (2013.01); *A43B 7/1445* (2013.01); *A43B 13/127* (2013.01); *A43B 13/146* (2013.01); *A43B 13/16* (2013.01); *A43B 13/28* (2013.01); *A43B 13/37* (2013.01); *A43B 21/51* (2013.01)

(58) Field of Classification Search

CPC ..... A43B 13/28; A43B 13/37; A43B 13/38; A43B 13/41; A43B 21/36; A43B 13/12

USPC ..... 36/24.5, 25 R, 30 R, 31, 44, 43, 76 R, 36/103, 107

See application file for complete search history.

(56) References Cited

U.S. PATENT DOCUMENTS

| | | | | | |
|---|---|---|---|---|---|
| 724,095 | A * | 3/1903 | Grover | A43B 13/34 | 36/24.5 |
| 1,847,287 | A * | 3/1932 | White | A43B 23/22 | 36/18 |
| 2,732,635 | A * | 1/1956 | Frost | A43B 13/34 | 36/24.5 |
| 6,874,254 | B1 * | 4/2005 | Silvera | A43B 3/102 | 36/11.5 |
| 7,614,164 | B2 * | 11/2009 | Morales | A43B 4/1445 | 36/24.5 |
| 8,256,142 | B2 * | 9/2012 | Igdari | A43B 7/142 | 36/102 |
| 8,713,818 | B2 * | 5/2014 | Doerer | A43B 7/1425 | 36/103 |
| 8,800,170 | B1 * | 8/2014 | Khaitan | A43B 17/026 | 36/28 |
| 8,800,171 | B1 * | 8/2014 | Khaitan | A43B 17/026 | 36/28 |
| 8,813,391 | B1 * | 8/2014 | Khaitan | A43B 21/00 | 36/28 |
| 2009/0188131 | A1 * | 7/2009 | Doerer | A43B 7/1425 | 36/88 |
| 2010/0011617 | A1 * | 1/2010 | Morales | A43B 7/1445 | 36/28 |
| 2010/0139123 | A1 * | 6/2010 | Alan | A43B 3/24 | 36/100 |

* cited by examiner

*Primary Examiner* — Marie Bays
(74) *Attorney, Agent, or Firm* — Leong C. Lei

(57) ABSTRACT

A high-heeled shoe includes an upper that is attached to the midsole and has a wearing opening. A midsole includes a midsole bed having a posterior portion that is recessed to form a first trough and a front pad that is mounted to an anterior portion of the midsole bed and is recessed to form a second trough and a third trough. A bottom support board is attached to a bottom surface of the midsole and includes an anterior end portion and a posterior end portion. The anterior end portion of the bottom support board is mounted to the bottom surface of the midsole in such a way as to partially overlap the front pad located on the midsole. A shoe heel is mounted to the posterior end portion of the bottom support board.

10 Claims, 9 Drawing Sheets

STRUCTURE OF HIGH-HEELED SHOE

TECHNICAL FIELD OF THE INVENTION

The present invention generally relates to a structure of a high-heeled shoe, and more particularly to a structure of a high-heeled shoe that alleviates front rushes of a foot in the high-heeled shoe so as to improve the safety and comfortableness of the foot wearing the high-heeled shoe.

DESCRIPTION OF THE PRIOR ART

To enable an "instantaneous" increase of the body height of a woman to a predetermined level and to allow the woman wearing the high-heeled shoe to talk in a stylish and beautiful manner, the footwear business provides a high-heeled shoe 1. As shown in FIG. 1, the high-heeled shoe 1 comprises an upper 11, a midsole 12, an outsole 13, and a shoe heel 14.

Referring to FIGS. 1 and 2, the upper 11 comprises a wearing opening 111. The upper 11 is attached, by means of adhesives or sewing, to the midsole 12. The upper 11 and the midsole 12, after being so combined, is fixed to the outsole 13 to form a unitary structure by means of adhesives or sewing. The midsole 12 comprises a soft pad 121 adhered to a top side thereof.

The outsole 13 comprises a support member 131 made of a metal in the form of a strip. When the midsole 12 is combined with the outsole 13, the support member 131 is enclosed between the midsole 12 and the outsole 13. The outsole 13 has a posterior end to which the shoe heel 14 is fixed by a fastening element P that extends through a fastening hole 1311 formed in the support member 131. The shoe heel 14 has a predetermined height so that the posterior portion of the high-heeled shoe 1 is kept at a distance from the ground.

Referring to FIGS. 1 and 3, in the use of the high-heeled shoe 1, afoot 2 of a wearer is put through the wearing opening 111 of the upper 11 into the high-heeled shoe 1. The foot 2 is set in contact with the midsole 12 with the heel 21 and the foot sole 22. More specifically, the body weight of the wearer is transmitted through the heel 21 and the foot sole 22 of the foot 2 to the midsole 12 so as to be supported by the outsole 13. In other words, the arch 23 of the foot 2 is generally in a condition of being not supported.

Further, both the midsole 12 and the outsole 13 have planer top surfaces. When a user wearing the shoe is walking, particularly for the condition where the shoe heel 14 of the outsole 13 has a substantial height, the heel 21 and the foot sole 22 of the foot 2 of the user may skid frontwards in the high-heeled shoe 1 in a not-stopped manner. Such a condition readily causes damages to the foot 2.

As shown in FIG. 3, the shoe heel 14 of the outsole 13 of the conventional high-heeled shoe 1 is generally of a substantial height. The area where the shoe sole portion 1*a* of the high-heeled shoe 1 contacts the ground E is concentrated at a central part of the shoe sole portion 1*a* of the high-heeled shoe 1. More specifically, the two opposite sides of the shoe sole portion 1*a* of the high-heeled shoe 1 are spaced from the ground E by a distance so that the shoe sole portion 1*a* of the high-heeled shoe 1 may undergo swinging and twisting when the high-heeled shoe 1 is worn to walk. This, together with the high-heeled shoe 1 not supporting the arch 23 of the foot 2 of the wearer, would lead to excessive twist and deformation of the arch 23 of the foot 2 in walking and thus cause extreme discomfort of the foot 2, or in a worse condition, causing damage to the arch 23.

Thus, it is a challenge of the shoe manufacturing industry to overcome the drawbacks of the conventional high-heeled shoe 1.

SUMMARY OF THE INVENTION

The primary object of the present invention is to provide a structure of a high-heeled shoe, which overcomes the problem that the conventional high-heeled shoe cannot prevent front rushes of the foot of a wearer in the high-heeled shoe and cannot provide a support to the arch of the foot and thus readily causes discomfort and hurt of the foot.

To achieve the object, the technical solution adopted in the present invention is that a structure of a high-heeled shoe is provided, wherein the high-heeled shoe comprises at least an upper, a midsole, a bottom support board, and a shoe heel. The upper is attached to the midsole. The upper comprises at least a wearing opening. The midsole is attached to the outsole. The midsole comprises a midsole bed and a front pad. The midsole bed has a posterior portion that is recessed to form a first trough. The front pad is mounted to an anterior portion the midsole bed. The front pad is recessed to form a second trough and a third trough. The bottom support board is attached to a bottom surface of the midsole. The bottom support board comprises an anterior end portion and a posterior end portion. The anterior end portion of the bottom support board is mounted to the bottom surface of the midsole so as to partially overlap of the front pad that is located on the top of the midsole. The shoe heel is mounted to the posterior end portion of the bottom support board.

With the above-described technical solution, the present invention achieves the following efficacy. By arranging a first trough, a second trough, and a third trough in the midsole and setting a first soft pad that corresponds in shape to the first trough in the first trough, setting a second soft pad that corresponds in shape to the second trough in the second trough, and setting a third soft pad that corresponds in shape to the third trough in the third trough, the midsole is provided with a plurality of rush stop sites thereon for alleviating front rushes of a foot in the high-heeled shoe so as to improve safety and comfortableness of the foot wearing the high-heeled shoe.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
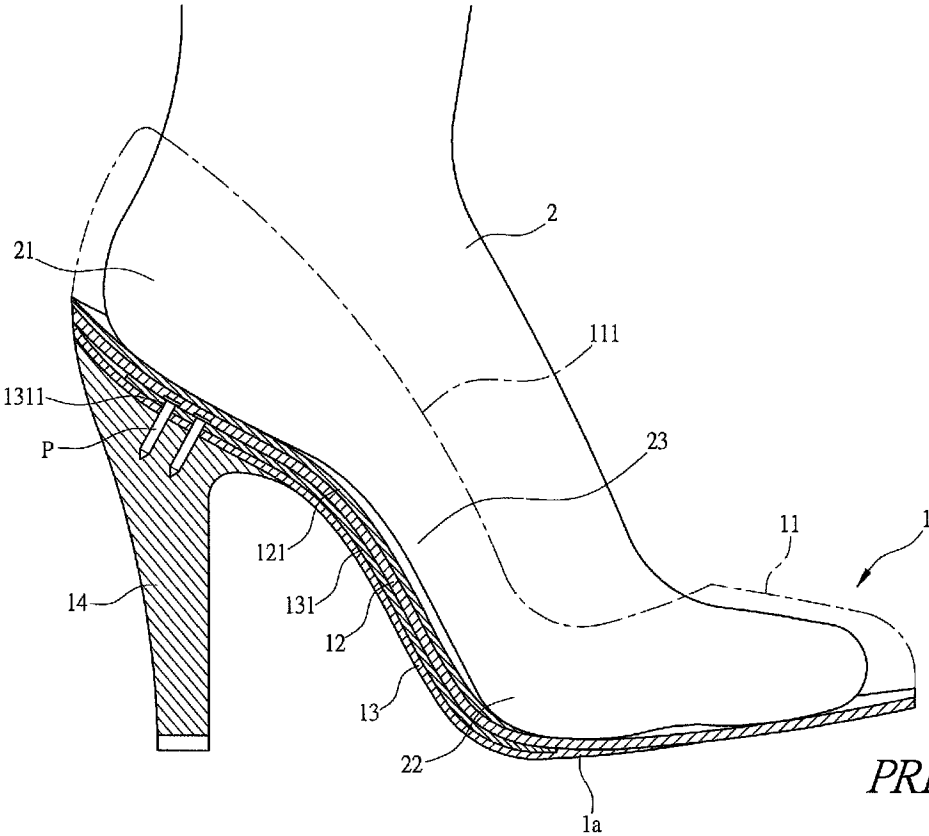
PRIOR ART FIG.1
FIG. 1 is a perspective view showing a conventional high-heeled shoe.
Figure 2:
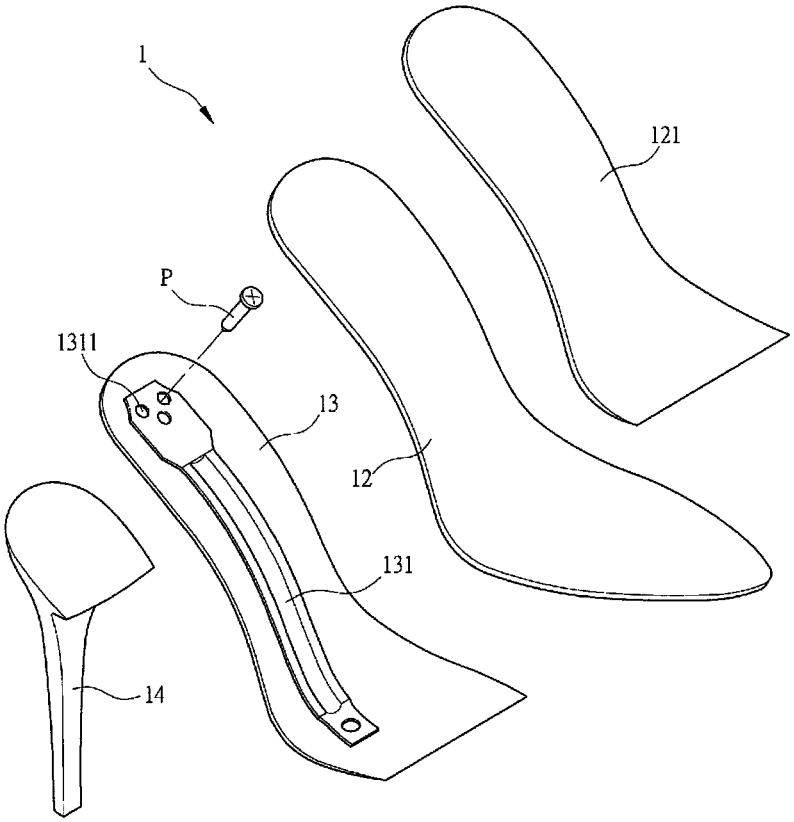
PRIOR ART FIG.2
FIG. 2 is an exploded view of the conventional high-heeled shoe.
Figure 3:
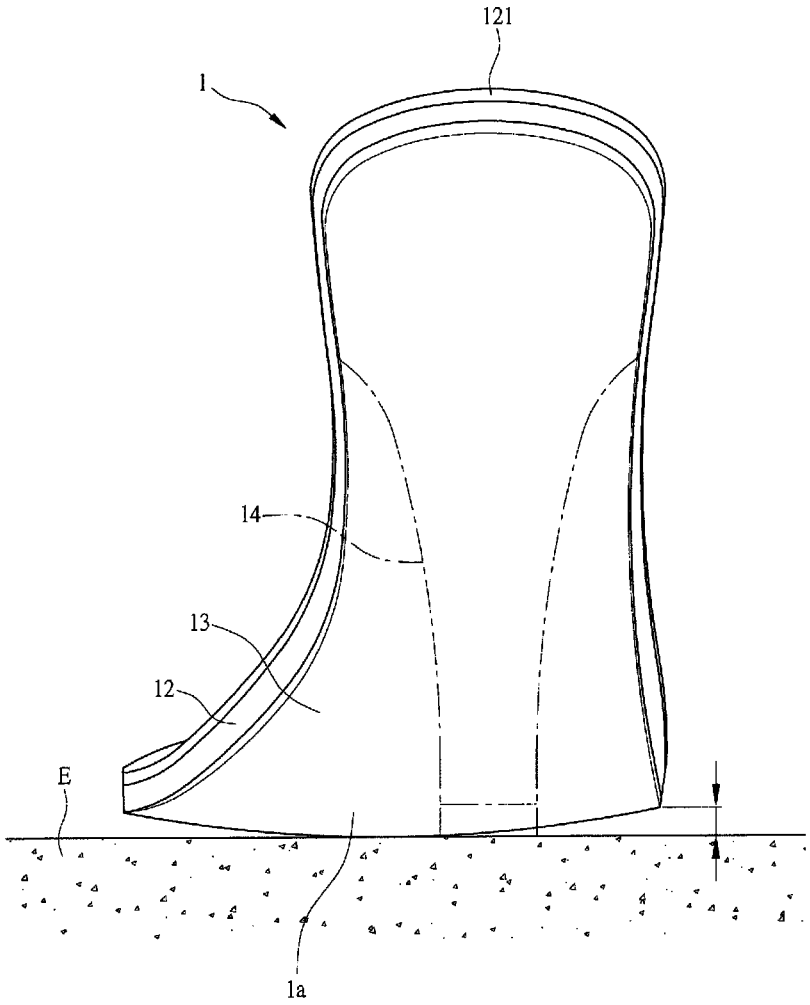
FIG. 3 is a schematic view showing the use of the conventional high-heeled shoe.
Figure 4:
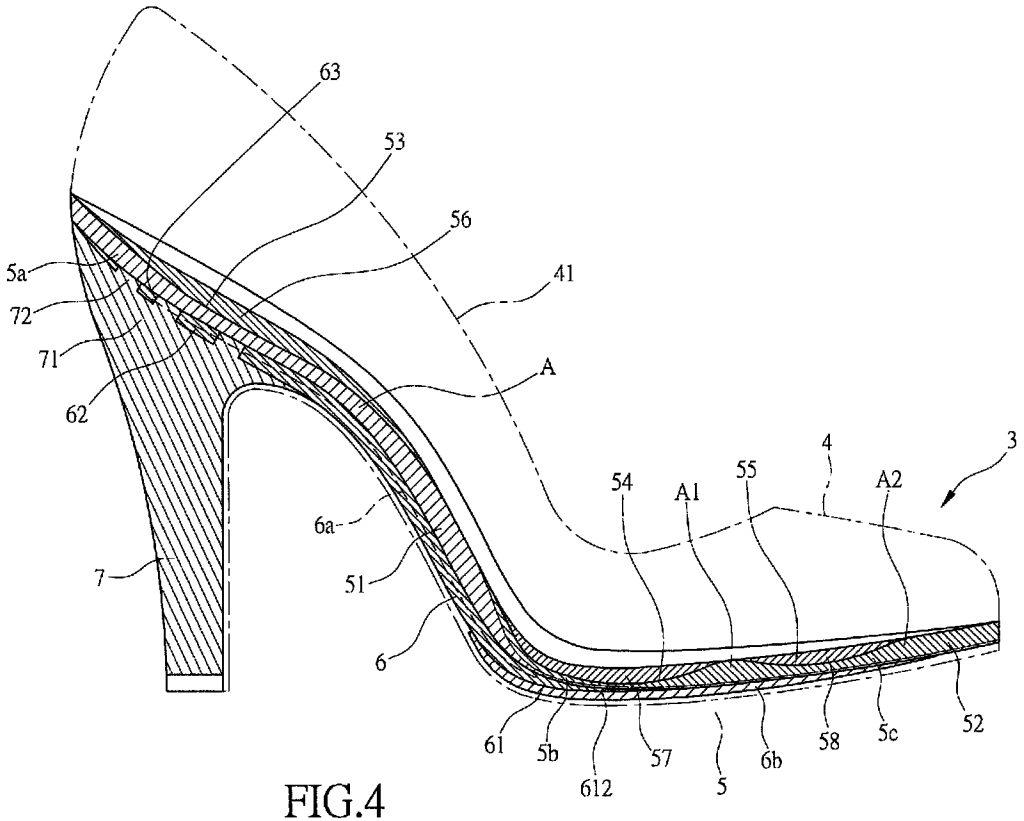
FIG. 4 is a schematic view showing a high-heeled shoe according to the present invention.

Referring first to FIG. 4, the present invention provides a structure of a high-heeled shoe. The high-heeled shoe 3 comprises at least an upper 4, a midsole 5, a bottom support board 6, and a shoe heel 7.

As shown in FIG. 4, the upper 4 is attached to the midsole 5 by means of adhesive or sewing. The upper 4 has at least a wearing opening 41.

Figure 5:
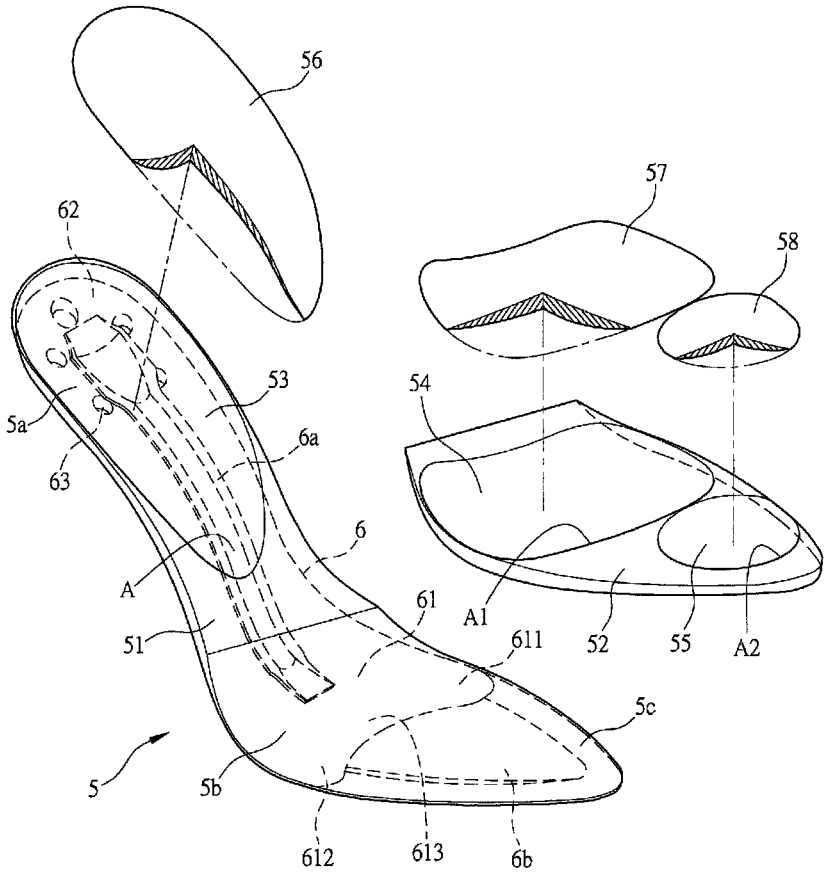
FIG. 5 is an exploded view showing a midsole of the shoe of the present invention.

As shown in FIGS. 4 and 5, the midsole 5 comprises a midsole bed 51 and a front pad 52. The midsole bed 51 has a posterior portion (corresponding to the location of the shoe heel 7) that is recessed to form a first trough 53. The front pad 52 is fixed in front of the midsole bed 51 in such a way that the front pad 52 is mounted to an anterior portion of the midsole bed 51 (corresponding to the location of a shoe sole portion). The front pad 52 is recessed to form a second trough 54 and a third trough 55.

The first trough 53 is arranged to extend in an axial direction of the midsole 5 and formed in the posterior portion of the midsole 5 (corresponding to the location of the shoe heel 7). The first trough 53 is a concave trough having a central part that is relatively deep and a circumferential part that is relatively shallow. The second trough 54 is arranged to extend in a transverse direction of the midsole 5 and formed in a posterior portion of the front pad 52. The second trough 54 is a concave recess having a central part that is relatively deep and a circumferential part that is relatively shallow. The third trough 55 is arranged to extend in a transverse direction of the midsole 5 and formed in an anterior portion of the front pad 52. The third trough 55 is a concave recess having a central part that is relatively deep and a circumferential part that is relatively shallow. More specifically, the first trough 53, the second trough 54, and the third trough 55 are arranged sequentially in a direction from the posterior portion of the high-heeled shoe 3 (the shoe heel 7) toward the anterior portion (the shoe sole portion).

The first trough 53 receives therein a first soft pad 56 that is formed to match the shape of the first trough 53. The second trough 54 receives therein a second soft pad 57 that is formed to match the shape of the second trough 54. The third trough 55 receives therein a third soft pad 58 that is formed to match the shape of the third trough 55. The first soft pad 56 completely fills the first trough 53. The second soft pad 57 completely fills the second trough 54. The third soft pad 58 completely fills the third trough 55. As such, the midsole 5 exhibits an upper surface that is a substantially smooth surface.

Figure 6:
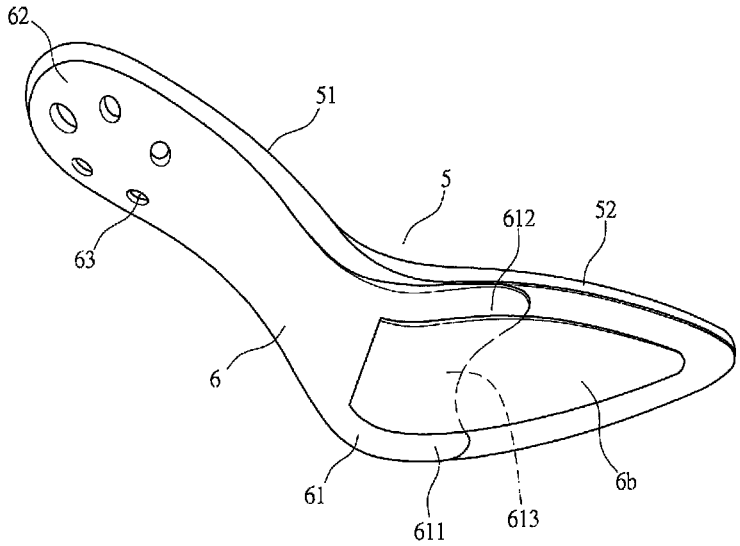
FIG. 6 is a perspective view showing a bottom support board of the shoe of the present invention.

As shown in FIGS. 4, 5, and 6, the bottom support board 6 is formed to enclose therein a supportive rib 6*a* that is made of a metal or a composite material mounted therein. The bottom support board 6 is mounted to the bottom surface of the midsole 5 in such a way that the supportive rib 6*a* extends in a direction from the posterior portion of the midsole 5 toward the anterior portion of the midsole 5. Further, between the anterior end of the bottom support board 6 and the anterior end of the midsole 5, a flexible ancillary bottom support plate 6*b* is mounted to the underside of the midsole 5 so that with the arrangement of the flexible ancillary bottom support plate 6*b*, the anterior end portion of the midsole 5 is made more flexible and cushioning. More specifically, an anterior end portion 61 of the bottom support board 6 is mounted to the bottom surface of the midsole 5 so as to partially overlap of the front pad 52 that is located on the top of the midsole 5, whereby the anterior end portion 61 of the bottom support board 6 helps expand the area of a she sole portion 5*b* of the midsole 5 contacting the ground E1. A posterior end portion 62 of the bottom support board 6 comprises a plurality of insertion holes 63 formed therein. More specifically, the anterior end portion 61 of the bottom support board 6 is arranged to show a configuration having two projecting side portions and a central concave portion, whereby the anterior end of the bottom support board 6 forms a first projecting section 611 and a second projecting section 612 and a concave section 613. The anterior end of the bottom support board 6 is also configured to get thickening from the concave section 613 toward the first projecting section 611 and the second projecting section 612. In other words, the first projecting section 611 and the second projecting section 612 have thicknesses that the thickness of the concave section 613. The first projection section 611 and the second projecting section 612 help expand the area of a she sole portion 5*b* of the midsole 5 contacting the ground E1. Further, the first projecting section 611 and the second projecting section 612 provides two support points, which, together with a supporting line from the concave section 613 to the supportive rib 6*a*, collectively form a triangular kinetic support by which the medial longitudinal arch, the lateral longitudinal arch and the anterior transverse arch of a foot 8 can be supported, thereby ensuring stability of standing and walking of the foot 8 wearing the high-heeled shoe 3.

Figures 7, 7A:
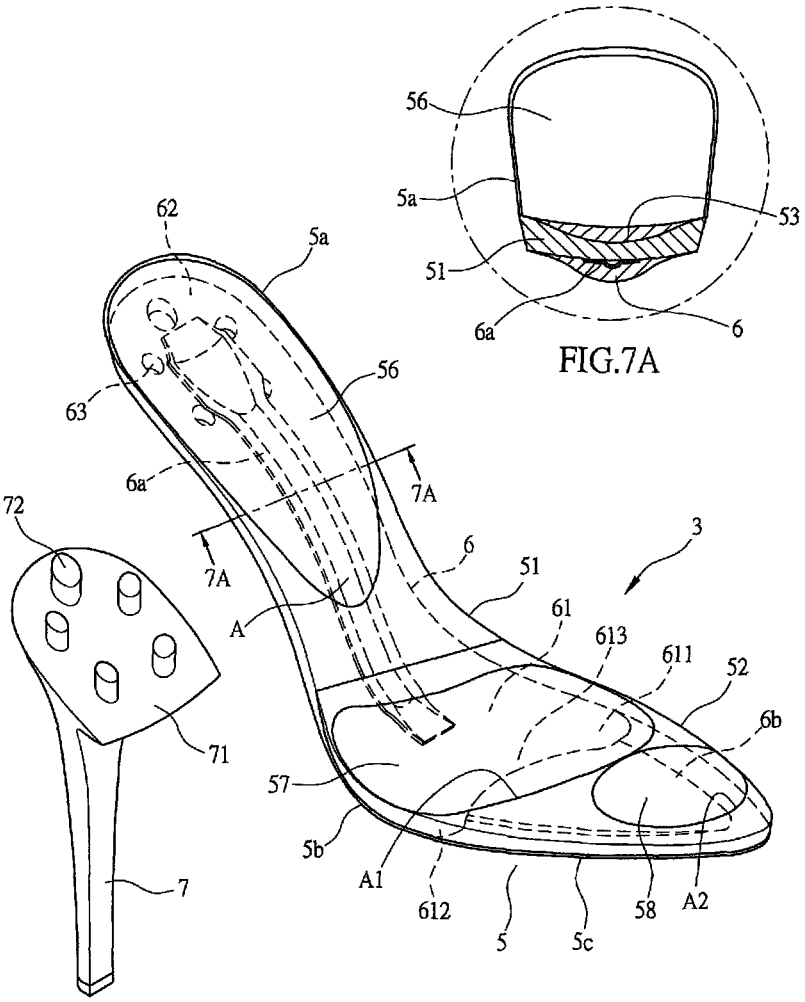
FIG. 7 is a perspective view, in a separated form, showing the midsole and a shoe heel of the shoe of the present invention.
FIG. 7A is a cross-sectional view taken along line 7A-7A of FIG. 7.

Referring to FIGS. 4 and 7, the shoe heel 7 is of a predetermined height. The shoe heel 7 has a top end that is provided with a coupling section 71 having a widened surface. The coupling section 71 comprises a plurality of insertion pins 72 formed thereon. The insertion pins 72 are arranged to correspond to the insertion holes 63 of the bottom support board 6, whereby the insertion pins 72 of the shoe heel 7 are insertable into the insertion holes 63 of the bottom support board 6 and the coupling section 71 is attachable by means of adhesives to the posterior end portion 62 of the bottom support board 6.

Referring to FIGS. 4, 5, 7, and 8, to assemble the high-heeled shoe 3 according to the present invention, as shown in FIGS. 7 and 7A, the midsole 5 and the bottom support board 6 are first mounted together. The shoe heel 7 is then bonded to the bottom support board 6. At the same time, the upper 4 is attached to the midsole 5 by means of adhesives or sewing to thereby complete the assembling of the high-heeled shoe 3 according to the present invention.

Figure 8:
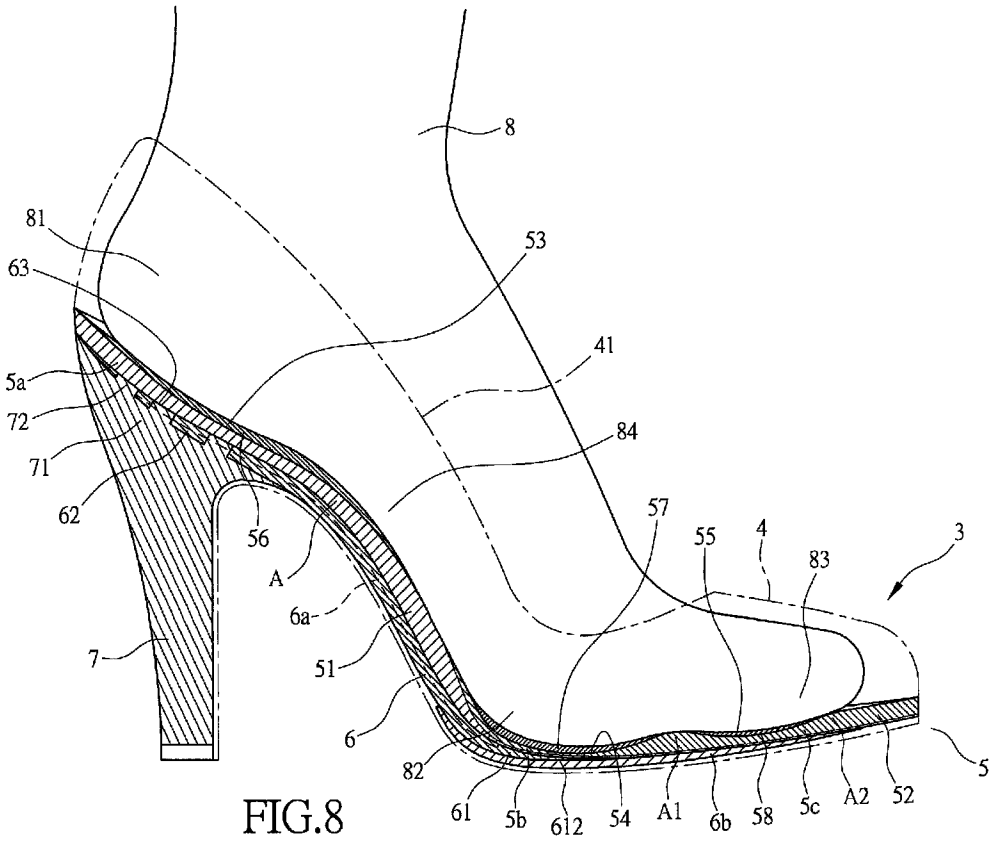
FIG. 8 is a schematic view showing the use of the high-heeled shoe according to the present invention.
Figure 9:
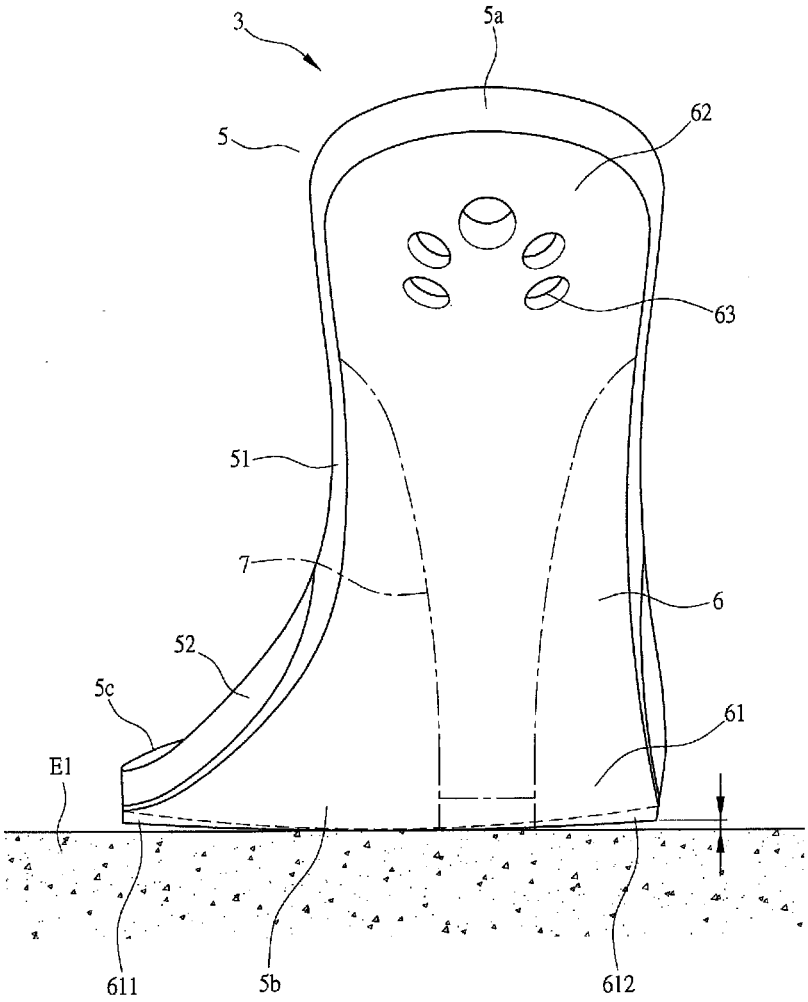
FIG. 9 is a schematic view illustrating the high-heeled shoe of the present invention in contact with the ground.

Referring to FIGS. 4, 8, and 9, to put the high-heeled shoe 3 of the present invention into practice, after a foot 8 of a wearer is put through the wearing opening 41 of the upper 4 into the high-heeled shoe 3, the heel 81 of the foot 8 is supported on a shoe heel portion 5*a* of the midsole 5. In other words, the heel 81 of the foot 8 is positioned on the first trough 53 and the first soft pad 56. The anterior sole 82 of the foot 8 is supported on the shoe sole portion 5*b* of the midsole 5. In other words, the foot sole 82 of the foot 7 is positioned on the second trough 54 and the second soft pad 57. The toes 83 of the foot 8 are supported on a shoe toe portion 5*c* of the midsole 5. In other words, the toes 83 of the foot 8 are positioned on the third trough 55 and the third soft pad 58. Further, the bottom support board 6 is located under the arch 84 of the foot 8, whereby through the effect of supporting provided by the bottom support board 6, the underside of the arch 84 of the foot 8 is positioned tightly against the midsole 5. As such, through the weight of the wearer, the first soft pad 56, the second soft pad 57, and the third soft pad 58 are compressed and thus sink down so as to form at least three rush stop sites in the midsole 5 of the high-heeled shoe 3, namely a first rush stop site A formed in an anterior end of the first trough 53 (toward the second trough 54), a second rush stop site A1 formed in an anterior end of the second trough 54 (toward the third trough 55), and a third rush stop site A2 formed in an anterior end of the third trough 55 (toward the anterior end of the midsole 5). More specifically, the first rush stop site A is located in front of the heel 81 of the foot 8; the second rush stop site A1 is located in front of the foot sole 82 of the foot 8; and the third rush stop site A2 is located in front of the toes 83 of the foot 8, whereby the first rush stop site A, the second rush stop site A1, and the third rush stop site A2 may help alleviate frontward rushes of the foot 8 in the high-heeled shoe 3 to thus improve the safety and conformableness of the foot 8 in the high-heeled shoe 3. It is noted that the second rush stop site A1 is located at the foot sole 82 of the foot 8 and can completely absorb the energy of impacts applied to the foot 8 during walking so as to prevent the foot sole 82 of the foot 8 from supporting the impact caused by the weight of the wearer in walking, whereby the comfort of the foot sole 82 of the foot 8 is improved.

As shown in FIG. 9, the arch 84 of the foot 8 is supported from the underside thereof by the bottom support board 6 that supports the underside of the midsole 5 so that the anterior end portion 61 of the bottom support board 6 helps expand the area of the shoe sole portion 5*b* of the midsole 5 contacting the ground E1 so as to prevent the shoe sole portion 5*b* of the midsole 5 of the high-heeled shoe 3 from swinging and twisting and also to provide a support to the arch 84 of the foot 8 by the bottom support board 6. As such, the overall conformableness and safety for protection against damage for the foot 8 wearing the high-heeled shoe 3 can be further improved.

An efficacy of the present invention is that by arranging the first trough 53, the second trough 54, and the third trough 55 in the midsole 5 and setting the first soft pad 56 that corresponds in shape to the first trough 53 in the first trough 53, setting the second soft pad 57 that corresponds in shape to the second trough 54 in the second trough 54, and setting the third soft pad 58 that corresponds in shape to the third trough 55 in the third trough 55, the midsole 5 is provided with a plurality of rush stop sites thereon for alleviating front rushes of a foot 8 in the high-heeled shoe 3 so as to improve safety and comfortableness of the foot 8 wearing the high-heeled shoe 3. Further, with the second rush stop site A1 located at the foot sole 82 of the foot 8, the energy of impacts applied to the foot 8 during walking can be completely absorbed so as to prevent the foot sole 82 of the foot 8 from supporting the impact caused by the weight of the wearer in walking, whereby the comfort of the foot sole 82 of the foot 8 is improved.

Another efficacy of the present invention is that the bottom support board 6 is provided on the bottom surface of the midsole 5 and the anterior end portion 61 of the bottom support board 6 is mounted to the bottom surface of the midsole 5 so as to partially overlap of the front pad 52 that is located on the top of the midsole 5, whereby the anterior end portion 61 of the bottom support board 6 helps expand the area of the she sole portion 5*b* of the midsole 5 contacting the ground E1 so as to prevent the shoe sole portion 5*b* of the midsole 5 of the high-heeled shoe 3 from swinging and twisting and also to provide a support to the arch 84 of the foot 8 by the bottom support board 6, to thereby improve the overall conformableness and safety for protection against damage for the foot 8 wearing the high-heeled shoe 3 and thus enhancing the overall utilization of the high-heeled shoe 3.

A further efficacy of the present invention is that the posterior end portion 62 of the bottom support board 6 comprises a plurality of insertion holes 63 formed therein and the coupling section 71 of the shoe heel 7 comprises a plurality of insertion pins 72 projecting therefrom to correspond to the insertion holes 63, where the insertion pins 72 are insertable into the insertion holes 63 to have the shoe heel 7 fixed to the bottom support board 6 in an extremely secured manner without causing the problem that the shoe heel 7 separates from the bottom support board 6 thereby further enhancing the utilization of the high-heeled shoe 3.

A further efficacy of the present invention is that the anterior end portion 61 of the bottom support board 6 exhibits a configuration having two projecting opposite sides and a concave central portion so as to form a first projecting section 611 and a second projecting section 612 and a concave section 613 at the anterior end of the bottom support board 6 with the anterior end of the bottom support board 6 being thickened from the concave section 613 towards the first projecting section 611 and the second projecting section 612 so that the first projecting section 611 and the second projecting section 612 provides two support points, which, together with a supporting line from the concave section 613 to the supportive rib 6*a*, collectively form a triangular kinetic support by which the medial longitudinal arch, the lateral longitudinal arch and the anterior transverse arch of a foot 8 can be supported, thereby ensuring stability of standing and walking of the foot 8 wearing the high-heeled shoe 3 so as to further ensure overall comfortableness and safety for protection against damage for the foot 8 wearing the high-heeled shoe 3 and thus improving the utilization of the high-heeled shoe 3.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a high-heeled shoe comprising at least an upper, a midsole, a bottom support board, and a shoe heel;

the upper being attached to the midsole, the upper comprising at least a wearing opening;

the midsole comprising a midsole bed and a front pad, the midsole bed having a posterior portion that is recessed to form a first trough, the front pad being mounted to an anterior portion of the midsole bed, the front pad being recessed to form a second trough and a third trough;

the bottom support board being attached to a bottom surface of the midsole, the bottom support board comprising an anterior end portion and a posterior end portion, the anterior end portion of the bottom support board being mounted to the bottom surface of the midsole in such a way as to partially overlap the front pad located on the midsole; and the shoe heel being mounted to the posterior end portion of the bottom support board.

2. The structure of the high-heeled shoe according to claim 1, wherein the bottom support board is integrally formed through injection molding and the bottom support board is located under an arch of a foot wearing the shoe to support the arch.

3. The structure of the high-heeled shoe according to claim 1, wherein the first trough is formed on the midsole bed of the midsole and located at a shoe heel portion of the midsole, the first trough being formed in the midsole in such a way as to extend in an axial direction of the midsole bed of the midsole, the first trough being a concave trough having a central part that is relatively deep and a circumferential part that is relatively shallow.

4. The structure of the high-heeled shoe according to claim 1, wherein the second trough is formed on the front pad of the midsole and located at a shoe sole portion of the midsole, the second trough being formed in the midsole in such a way as to extend in a transverse direction of the midsole, the second trough being a concave trough having a central part that is relatively deep and a circumferential part that is relatively shallow.

5. The structure of the high-heeled shoe according to claim 1, wherein the third trough is formed on the front pad of the midsole and located at a shoe toe portion of the midsole, the third trough being formed in the midsole in such a way as to extend in a transverse direction of the midsole, the third trough being a concave trough having a central part that is relatively deep and a circumferential part that is relatively shallow.

6. The structure of the high-heeled shoe according to claim 1, wherein the posterior end portion of the bottom support board comprises a plurality of insertion holes formed therein, a coupling section of the shoe heel comprising insertion pins formed thereon to correspond to the insertion holes, whereby the insertion pins are insertable into the insertion holes.

7. The structure of the high-heeled shoe according to claim 1, wherein the midsole comprises a first rush stop site, a second rush stop site, and a third rush stop site, the first rush stop site being formed in an anterior end of the first trough, the second rush stop site being formed in an anterior end of the second trough, the third rush stop site being formed in an anterior end of the third trough, whereby the first rush stop site is located in front of the heel of a foot wearing the shoe, the second rush stop site is located in front of a foot sole of the foot, and the third rush stop site is located in front of toes of the foot.

8. The structure of the high-heeled shoe according to claim 1, wherein the anterior end portion of the bottom support board exhibits a configuration having two projecting opposite sides and a concave central portion so as to form a first projecting section and a second projecting section and a concave section at the anterior end of the bottom support board with the anterior end of the bottom support board being thickened from the concave section towards the first projecting section and the second projecting section so that the first projecting section and the second projecting section provides two support points, which, together with a supporting line from the concave section to a supportive rib, collectively form a triangular kinetic support by which the medial longitudinal arch, the lateral longitudinal arch and the anterior transverse arch of a foot wearing the shoe are supported.

9. The structure of the high-heeled shoe according to claim 1, wherein the bottom support board comprises a supportive rib arranged therein, the supportive rib being made of a metal or a composite material.

10. The structure of the high-heeled shoe according to claim 1, wherein a flexible ancillary bottom support plate is mounted to an underside of the midsole between the anterior end of the bottom support board and an anterior end of the midsole.

* * * * *